United States Patent [19]

Yochum et al.

[11] 4,378,550

[45] Mar. 29, 1983

[54] PROCESS FOR FORMING IGNITION CABLE CORE AND PRODUCT OF THE PROCESS

[75] Inventors: Edwin L. Yochum, Elgin; William G. Smith, St. Charles, both of Ill.

[73] Assignee: Belden Corporation, Geneva, Ill.

[21] Appl. No.: 200,473

[22] Filed: Oct. 24, 1980

[51] Int. Cl.[3] ..... H01C 3/06

[52] U.S. Cl. ..... 338/214; 338/66

[58] Field of Search ..... 338/66, 214; 174/120 SC, 102 SC, 105 SC, 106 SC, 113 R, 104; 252/510, 511; 156/50, 51, 52; 427/118; 428/373, 36

[56] References Cited

U.S. PATENT DOCUMENTS

| | | | |
|---|---|---|---|
| 2,446,387 | 8/1948 | Peterson | 338/214 X |
| 2,563,952 | 8/1951 | Nichol | 338/214 X |
| 3,861,025 | 1/1975 | Smith-Johannsen et al. | 338/214 X |
| 3,889,049 | 6/1975 | Legg et al. | 174/113 R X |
| 4,145,317 | 3/1979 | Sado et al. | 252/54 X |

*Primary Examiner*—C. L. Albritton

*Attorney, Agent, or Firm*—Fitch, Even, Tabin, Flannery & Welsh

[57] ABSTRACT

A process for forming ignition cable core and a product of the process are described wherein multiple strength filaments are individually coated with an electrically conductive, curable elastomeric material, a common overcoating surrounding the mixture, then cabled together and again coated with the individually coated strength filaments in order to form the core for an ignition cable which is characterized by improved resistance to separation between the filament and conductive coating, for example, when the ignition cable core is stripped for electrical termination.

22 Claims, 2 Drawing Figures

PROCESS FOR FORMING IGNITION CABLE CORE AND PRODUCT OF THE PROCESS

The present invention relates to a process for forming ignition cable core as well as a product of the process and more particularly to such a process and product wherein the ignition cable core is formed from a plurality of strength filaments.

Ignition cable of the type referred to above is well known in the prior art as exemplified by U.S. Pat. No. 3,284,751 issued Nov. 8, 1966 to Barker et al. The Barker patent teaches the formation of such an ignition cable from a plurality of individual strength filaments formed for example from cotton, rayon, linen, glass fiber or synthetic materials. Mixtures of different types of filament could also be used. In any event, the individual filaments were impregnated with conductive material such as graphite carried in a colloidal solution, dried and passed as a group through a suitable applicator to deposit a conductive elastomer about the group of threads. After the coated filament group was again dried, a further conductive layer was applied over the conductive rubber or elastomer to provide a release surface for subsequent layers of material, for example, insulation or the like. The final conductive release coating applied in the Barker et al. process preferably consisted of a colloidal solution of graphite in alcohol into which the ignition cable was dipped and again dried.

A further improvement over the ignition cable described in the Barker et al. patent was disclosed in a copending patent application Ser. No. 27,188 entitled "Electrically Conductive Silicone Elastomers" filed by Gerald P. Kehrer et al. On Apr. 4, 1979 and assigned to Dow-Corning Corporation. That reference also contemplated the use of an electrically conductive low viscosity curable silicone elastomeric mixture or composition applied to a plurality of non-conductive strength filaments.

However, the process for forming the ignition cable was simplified by the addition of chopped graphite fibers to the elastomeric mixture to improve to an unexpected degree the conductivity of the cured electrically conductive silicone elastomer and thereby obviate the need for applying conductive particles directly to the strength filaments. In addition, it was found to be unnecessary to apply a further conductive release coating to the electrically conductive low viscosity cured silicone elastomer since the surface of the electrically conductive material itself formed a satisfactory release surface for materials such as insulation applied thereover.

Ignition cable core formed by processes such as those described above and including a conductive elastomeric of silicone, for example, has proven satisfactory in electrical performance. However, with the conductive elastomeric coating being formed from a low viscosity liquid suitable for pumping during application, it has been found that the conductive coating often tends to separate from the non-conductive strength filament, for example, when the ignition cable is stripped of insulation in an electrical termination operation. One possible solution to this problem might lie in the use of an extruder for developing greater pressure within the applicator during deposition of the conductive elastomeric coating upon the strength filaments. In this manner, the increased pressurization developed during application might tend to achieve more intimate impregnation of the conductive elastomeric coating on the strength filaments in order to assure a cohesive bond throughout the conductive coating tending to resist separation of the type referred to above. However, the application step itself becomes substantially more involved with the use of extruders because of the higher pressures developed.

Accordingly, there has been found to remain a need for a process for forming ignition cable core from non-conductive strength filament with a coating of conductive elastomeric material while minimizing the tendency for separation between the conductive coating and the strength filaments.

SUMMARY OF THE INVENTION

It is therefore an object of the present invention to provide a process for forming ignition cable core by the application of an electrically conductive, curable elastomeric material to a plurality of non-conductive strength filaments while minimizing the tendency for separation between the conductive coating and the strength filament.

In accordance with the invention, it is contemplated that the individual coatings may initially be applied to each of the plurality of strength filaments, the common overcoating then being applied to a combination of the individually coated strength filaments. However, it will also be apparent that the invention contemplates application of the individual coatings and common overcoating in a single process. However, in any event, the invention essentially contemplates a composite coating for the ignition cable core including an individual coating surrounding each of the strength filaments and a common overcoating surrounding the plurality of individually coated strength filaments.

A process for forming such ignition cable core is provided by the present invention wherein an individual coating of the conductive elastomeric material is applied to surround each strength filament individually, a common overcoating being applied to a plurality of the individually coated strength filaments. The ignition cable core formed as a product of this process has been found to provide satisfactory electrical performance while also exhibiting increased resistance to separation between the conductive coating and the non-conductive strength filaments.

It is theorized that the individual coatings applied to each of the plurality of strength filaments cooperate with the common overcoating of conductive material to achieve greater cohesive strength within the conductive coating around the plurality of strength filaments. It is believed that the process of the present invention is particularly important where the individual strength filaments are coated with an oil or other material tending to resist the formation of a bond with the cured silicone elastomer.

Additional objects and advantages of the present invention are made apparent in the following description having reference to the accompanying drawing.

DESCRIPTION OF THE PREFERRED EMBODIMENT

Figure 1:
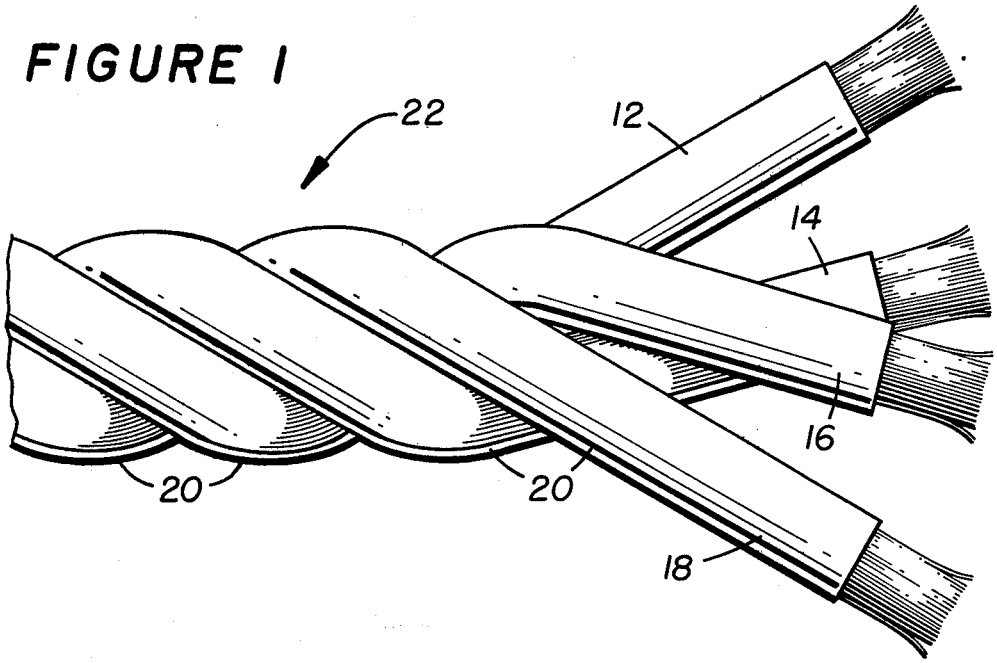
FIG. 1 illustrates an assembly of individually coated strength filaments.

As indicated above, the present invention relates to a process for forming ignition cable core and the product of the process. The ignition cable core of the present invention exhibits conductivity at a level permitting direct current to travel along the core for firing a spark plug while high frequency pulses generated by the spark are limited or prevented from returning through the core. Radiation of these high frequency pulses by the ignition system is undesirable since they tend to generate radio frequency and electromagnetic interference.

In forming the ignition cable core of the present invention, the strength filaments may be initially treated with conductive material, as described above, in order to increase conductivity of the ignition cable core. On the other hand, the use of a relatively high conductivity coating such as that provided by the above noted reference eliminates the need for an extra processing step to apply the conductive particles to the strength fibers. Rather, use of graphite fibers within the conductive coating is taught by that reference to produce a sufficiently high conductivity in the conductive coating alone. However, it will be apparent from the following description that strength fibers impregnated with conductive particles could be used within the present invention if desired.

The present invention particularly contemplates a process for forming ignition cable core where an electrically conductive, curable elastomeric material is applied to form an individual coating surrounding each of the filaments with a common overcoating for the individually coated strength filaments. The plurality of filaments may be assembled and cabled together in the manner illustrated in FIG. 1 or simply arranged in parallel to have the cross-sectional configuration of FIG. 2 at any point along their length.

The conductive coating is preferably applied to the individual strands and to the assembly of strength filaments by means of a conventional low pressure applicator or relatively high pressure extruder as described in greater detail below. One version of the invention particularly contemplates the coating being pumped into the applicator at relatively low pressure. Thus, the use of a relatively low viscosity elastomeric mixture or composition is important in order to assure its intimate contact with and about the strength filaments. Another version contemplates use of a relatively high pressure extruder to permit use of higher viscosity materials while still forming the individual coatings surrounding each strength filament.

As was also noted above, the ignition cable core produced by the process of the present invention has been found to exhibit an unexpected degree of resistance to separation between the strength filaments and the conductive coating within the core. It is theorized that this increased resistance to separation is the result of improved cohesion within the individual conductive coating formed about each of the strength filaments.

The strength filaments may be formed from single or multiple strands of any non-metallic material capable of withstanding the intended temperatures of manufacture and use. Preferred materials for the filaments include glass, carbon or graphite fiber, synthetic materials such as aramid fibers or the like or even mixtures of such filaments. The invention particularly contemplates the use of non-conductive filaments formed from an aramid fiber of 400 Denier available from DuPont under the tradename KEVLAR.

A plurality of the strength filaments are combined to form the ignition cable core. Preferably, from 3–5 filaments and even more preferably 4 filaments are employed to form the ignition cable core. However, it is to be kept in mind that other types of filaments could also be used in the present invention, even a combination of non-conductive and conductive strength filaments if desired for example in order to adjust the electrical conductivity of the finished product.

As was also indicated above, the conductive coating for the ignition cable core is preferably an electrically conductive, low viscosity, curable elastomeric mixture or composition which may for example be of a silicone type disclosed as by either of the references noted above. However, the invention also contemplates use of other silicone elastomeric mixtures, acrylic-latex elastomers in a water base or any of a variety of elastomers in an organic solvent with the proportion of solvent adjusted to yield the desired viscosity, all well known in the prior art.

Preferably, the elastomeric mixture includes chopped graphite fibers as disclosed by the second noted reference above or conductive particles in order to simplify the process for manufacturing the ignition cable core while maintaining high conductivity.

Such an electrically conductive silicone elastomer may comprise a product obtained by combining an elastomeric mixture having a viscosity below 1000 Pa.s at 25° C. and graphite fibers with an average length of from about 1 mm to about 6 mm, the graphite fibers being present in an amount of from about 0.3% to 5.0% by wgt. based on the weight of the elastomeric composition. The elastomeric composition may also have conductive particles suspended therein, formed for example as electrically conductive carbonaceous particles (consisting of either carbon or graphite particles) having an average particle diameter of less than 20 micrometers. The silicone mixture preferably includes about 15–60 parts by weight of such particles per 100 parts of silicone mixture. Use of this preferred silicone elastomeric mixture is also advantageous in that it may be applied without the need for a solvent which in turn avoids the need for drying of the coated filaments in order to remove the solvent.

In any event, it is particularly important that the final viscosity of the silicone composition be sufficiently low in order to allow it to be pumped in conventional application equipment of the type described below. In such application techniques, the viscosity of the final mixture is dependent at least upon the viscosity of the beginning electrically conductive elastomeric mixture, the method of mixing and the amount and particular characteristics of the conductive material added to the elastomeric composition. Elastomeric compositions including suspended conductive particles as disclosed above are particularly contemplated for use in relatively high pressure extruders where the use of graphite fibers may not be suitable.

In one version, the present invention is preferably carried out in a conventional coating applicator of the type described in the article, "High Temperature Ignition Core Fabrication Using a Liquid Silicone Rubber" published by the Society of Automotive Engineers, Inc. as Paper 770866 at the Passenger Car Meeting in Detroit, Mich. on Sept. 26, 1977. According to that paper, a coating material such as the silicone elastomer referred to above is supplied to the applicator at a sufficiently low viscosity permitting it to be coated onto the base filament using a modified cross-head arrangement similar to that customarily used to apply insulation to electrical wires. In the process, the filaments are continuously fed through the cross-head while the composition is forced about the filaments and shaped by the cross-head and exit die of the cross-head. The composition may be fed to the cross-head by means of pumps or by a pressure pot using air pressure as the driving force. The precoated filaments exiting from the applicator are then cured by passing through a hot-air oven. With the preferred elastomeric material referred to above being employed without need for solvent, the curing step for the filaments is substantially reduced and no volatile by-products are generated during final curing of the coated filaments.

In this version of the invention, an individual coating is first applied to each strength filament after which a plurality of the coated strength filaments are assembled together again and passed through the applicator to receive an overcoating of the same elastomeric mixture. After application of the overcoating, the finished ignition cable core is then again cured, after which a conventional insulation material formed, for example, from nylon may be applied as a protective jacket.

The thickness of the composite coating including the individual coatings and the common overcoating may vary depending upon the application for the finished ignition cable and particularly depending upon the volume resistivity for the conductive coating employed. For example, if four strength filaments formed from 400 Denier KEVLAR aramid fiber having a breaking strength of approximately 19 lbs. are to be formed into a 7 mm diameter ignition cable core, an individual precoating is applied to each of the filaments with a thickness of 3–5 mils. (or approximately 0.075–0.125 mm). After the individually precoated filaments are cured, a final overcoat of the same material may thereafter be applied for the specific ignition cable core referred to above, the overcoating having a nominal thickness of at least approximately 3 mils (about 0.075 mm).

Figure 2:
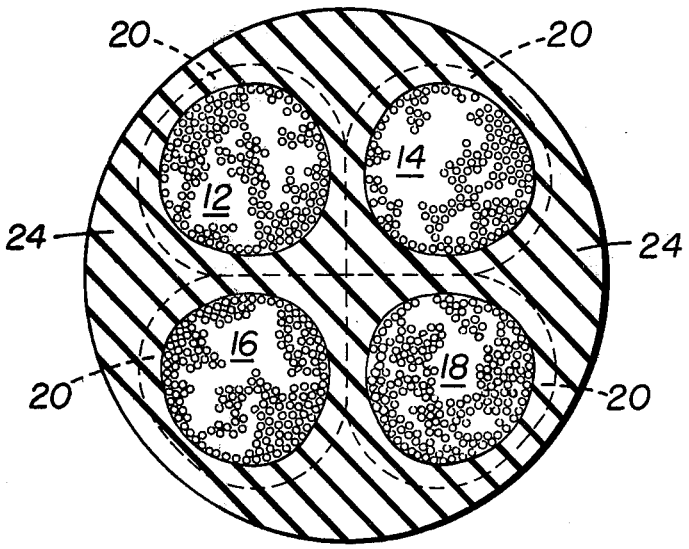
FIG. 2 is a sectional view of an ignition cable core formed by the process of the present invention by adding a common overcoating to the assembly of FIG. 1.

A specific example of ignition cable core formed according to the present invention is illustrated in FIGS. 1 and 2, the process for forming the ignition cable core being described in greater detail below.

Initially, individual strength filaments formed from 400 Denier KEVLAR aramid fiber having a breaking strength of approximately 19 lbs. are individually coated with the silicone elastomeric composition referred to above in an applicator of the type also disclosed above. The conductive precoating is applied to each of the filaments to a thickness of approximately 3–5 mils (or about 0.075–0.125 mm) after which the individually precoated filaments are cured and cabled together as illustrated in FIG. 1. Referring also to FIG. 2, the ignition cable core indicated at 10 in FIG. 2 is formed from four individual filaments indicated respectively at 12, 14, 16 and 18, each of the individual filaments having a precoating indicated at 20. The four precoated filaments are then combined with the overcoating being applied to the individually coated filaments as indicated at 24 in FIG. 2. The thickness for the overcoating 24 is also at least 3 mils (or approximately 0.075 mm).

In accordance with conventional practice, the ignition cable core 10 of FIG. 2 would have an insulation covering applied thereto. However, for purposes of simplicity, and to better illustrate the construction of the ignition cable core itself, the insulation jacket is not illustrated in FIG. 2.

In another version of the invention, the same coating material is employed in the same type of applicator disclosed in the preceding example. However, production of the ignition cable core is further simplified by applying the individual coatings and the common overcoating in a single step operation. In this version of the invention, a plurality of uncoated strength filaments are passed through the applicator while being maintained in spaced-apart relation in order to permit the low viscosity elastomeric material to form an individual coating surrounding each of the strength filaments while also forming a common overcoating generally surrounding the entire assembly of individually coated strength filaments. The composite coating formed in this version of the invention includes an individual coating surrounding each individual strength filament as indicated at 20 in FIG. 2 and a common overcoating as indicated at 24 in FIG. 2. The composite coating could be formed, for example, by passing the strength filaments 12–18 through the applicator while maintaining relative spacing as is illustrated in FIG. 2. This version of the invention could, of course, be employed either with the strength filaments being arranged in parallel relation along the length of the ignition cable core or in the cabled relation illustrated in FIG. 1.

As was also noted above, the invention further contemplates use of elastomeric materials of relatively higher viscosity. In order to assure formation of individual coatings surrounding each of the strength filaments, an extruder of conventional design would be employed for applying the higher viscosity elastomeric material. Here again, the strength filaments are held in spaced-apart relation during passage through the extruder in order to permit formation of individual coatings about each of the strength filaments. Generally, use of such an extruder tends to preclude use of graphite fibers in the conductive elastomer. However, an elastomer including suspended conductive particles as described in greater detail above could be employed within this version of the invention. In any event, the invention contemplates use of a relatively high viscosity elastomeric material and extruder to form an ignition cable core as generally indicated in FIG. 2 with an individual coating such as that indicated at 20 surrounding each of the individual strength filaments and a common overcoating as generally indicated at 24.

Additional variations and modifications other than those specifically referred to above are believed obvious from the description of the invention. Accordingly, the scope of the present invention is defined only by the following appended claims.

What is claimed is:

1. In a process for applying a conductive coating to an ignition cable core including a plurality of individual strength filaments, the steps comprising forming an individual coating respectively surrounding each of the individual strength filaments and forming a common overcoating for a plurality of the individually coated filaments, the individual coatings and the common overcoating being applied as a curable elastomeric material which is cross-linked to form the individual coatings and common overcoating, the resulting coating for the ignition cable core being characterized by increased resistance to separation of the individual strength filaments from the coating.

2. The process of claim 1 wherein the elastomeric material from which the individual coatings and the common coating are formed is a low viscosity material during application.

3. The process of claim 2 further comprising the step of adding graphite fibers to the low viscosity elastomeric mixture for the individual coatings and for the common overcoating.

4. The process of claim 1 wherein the individual coatings for the respective individual strength filaments are initially applied and cross-linked, the common overcoating then being applied to an assembly of the individually coated strength filaments and cross-linked.

5. The process of claim 4 wherein the elastomeric material from which the individual coatings and the common coating are formed is a low viscosity material during application.

6. The process of claim 5 further comprising the step of adding graphite fibers to the low viscosity elastomeric mixture for the individual coatings and for the common overcoating.

7. The process of claim 1 wherein the elastomeric material from which the individual coatings and common overcoating are formed is a high viscosity material including conductive particles suspended therein during application.

8. The process of claim 1 further comprising the step of employing a plurality of three to five strength filaments to form the ignition cable core.

9. The process of claim 1 wherein the nominal thicknesses for the individual coatings on the strength filaments and the common overcoating are approximately equal.

10. The process of claim 1 wherein the individual coatings for the strength filaments and the common overcoating have nominal thicknesses of at least approximately 0.075 millimeters.

11. The process of claim 1 wherein the elastomeric mixture for the individual coatings and the common overcoating is a low viscosity material, the individual strength filaments being formed from non-conductive fibers, the individual coatings and the common overcoating including graphite fibers having an average length of from about 1 mm to about 6 mm in order to produce satisfactory conductivity within the ignition cable core.

12. An ignition cable core including a plurality of individual strength filaments and formed as a product of a process comprising the steps of forming an individual coating respectively surrounding each of the individual strength filaments and forming a common overcoating for a plurality of the individually coated filaments, the individual coatings and the common overcoating being applied as a curable elastomeric material which is then cross-linked to form the individual coatings and common overcoating, the resulting coating for the ignition cable core being characterized by increased resistance to separation of the individual strength filaments from the coating.

13. The product of claim 12 wherein the elastomeric material from which the individual coatings and the common coatings are formed is a low viscosity material during application.

14. The product of claim 13 wherein graphite fibers are added to the low viscosity elastomeric mixture for the individual coatings and for the common overcoating.

15. The product of claim 12 wherein the individual coatings for the respective individual strength filaments are initially applied and cross-linked, the common overcoating then being applied to an assembly of the individually coated strength filaments and cross-linked.

16. The product of claim 15 wherein the elastomeric material from which the individual coatings and the common coating are formed is a low viscosity material during application.

17. The product of claim 16 wherein graphite fibers are added to the low viscosity elastomeric mixture for the individual coatings and for the common overcoating.

18. The product of claim 12 wherein the elastomeric material from which the individual coatings and common overcoating are formed is a high viscosity material including conductive particles suspended therein during application.

19. The product of claim 12 wherein a plurality of three to five strength filaments form the ignition cable core.

20. The product of claim 12 wherein the nominal thicknesses for the individual coatings on the strength filaments and the common overcoating are approximately equal.

21. The product of claim 12 wherein the individual coatings for the strength filaments and the common overcoating have nominal thicknesses of at least approximately 0.075 millimeters.

22. The product of claim 12 wherein the elastomeric mixture for the individual coatings and the common overcoating is a low viscosity material, the individual strength filaments being formed from non-conductive fibers, the individual coatings and the common overcoating including graphite fibers having an average length of from about 1 mm to about 6 mm in order to produce satisfactory conductivity within the ignition cable core.

* * * * *